US009710003B2

(12) United States Patent
El-Nozahi et al.

(10) Patent No.: US 9,710,003 B2
(45) **Date of Patent: *Jul. 18, 2017**

(54) LDO AND LOAD SWITCH SUPPORTING A WIDE RANGE OF LOAD CAPACITANCE

(71) Applicant: Vidatronic, Inc., College Station, TX (US)

(72) Inventors: Mohamed Ahmed Mohamed El-Nozahi, Heliopolis (EG); Mohamed Mostafa Saber Aboudina, College Station, TX (US); Sameh Assem Ibrahim, College Station, TX (US); Faisal Abdellatif Elseddeek Ali Hussien, College Station, TX (US); Moises Emanuel Robinson, College Station, TX (US)

(73) Assignee: Vidatronic, Inc., College Station, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/776,349

(22) PCT Filed: Mar. 14, 2014

(86) PCT No.: PCT/US2014/028164
§ 371 (c)(1),
(2) Date: Sep. 14, 2015

(87) PCT Pub. No.: WO2014/152901
PCT Pub. Date: Sep. 25, 2014

(65) Prior Publication Data

US 2016/0026199 A1 Jan. 28, 2016

Related U.S. Application Data

(63) Continuation of application No. 13/916,252, filed on Jun. 12, 2013, now abandoned, which is a
(Continued)

(51) Int. Cl.
*G05F 1/565* (2006.01)
*G05F 1/575* (2006.01)
*G05F 1/573* (2006.01)

(52) U.S. Cl.
CPC ..... *G05F 1/575* (2013.01); *G05F 1/565* (2013.01); *G05F 1/573* (2013.01)

(58) Field of Classification Search
CPC . G05F 1/56; G05F 1/565; G05F 1/571; G05F 1/573; G05F 1/575
(Continued)

(56) References Cited

U.S. PATENT DOCUMENTS 5,563,501 A * 10/1996 Chan ..... G05F 1/565 323/273
6,300,749 B1 10/2001 Castelli et al.
(Continued)

OTHER PUBLICATIONS

International Preliminary Report on Patentability and Written Opinion issued in corresponding International Application No. PCT/US2014/028164 dated Sep. 24, 2015, (3 pages).
Office Action issued in related U.S. Appl. No. 13/830,478 mailed May 5, 2014 (19 pages).
International Search Report issued in PCT/US2014/028164 mailed on Jan. 22, 2015 (1 page).
(Continued)

*Primary Examiner* — Gary L Laxton
*Assistant Examiner* — Jye-June Lee
(74) *Attorney, Agent, or Firm* — Osha Liang, LLP

(57) ABSTRACT

An architecture and method to maintain stability of a low drop-out (LDO)/load switch linear voltage regulator (LVR). The architecture method support optionally determining during a power-up phase and by using a load detection circuit, the estimated load parameters that represents at least
(Continued)

one selected from a group consisting of: the load time constant and the load resistor at an output node of the LDO/load switch LVR, and adjusting, based on the estimated output load parameters, an adaptive RC network in the LDO/load switch LVR, wherein the adaptive RC network produces an adaptive zero in a feedback network transfer function of the LDO/load switch LVR, wherein the adaptive zero reduces an effect of a non-dominant pole in the open loop transfer function of the LDO/load switch LVR, and wherein a frequency of the adaptive zero is adjusted based on the estimated load parameters.

19 Claims, 10 Drawing Sheets

Related U.S. Application Data continuation-in-part of application No. 13/830,478, filed on Mar. 14, 2013, now Pat. No. 8,917,070.

(58) Field of Classification Search
USPC ..... 323/273–275, 280, 281
See application file for complete search history.

(56) References Cited

U.S. PATENT DOCUMENTS

| | | | | |
|---|---|---|---|---|
| 6,541,946 | B1 * | 4/2003 | Chen | G05F 1/575 323/274 |
| 6,603,292 | B1 | 8/2003 | Schouten et al. | |
| 6,700,361 | B2 * | 3/2004 | Gregorius | G05F 1/575 323/274 |
| 7,521,909 | B2 * | 4/2009 | Dow | G05F 1/575 323/274 |
| 8,115,463 | B2 | 2/2012 | Wang | |
| 8,232,783 | B2 | 7/2012 | Yanagawa | |
| 2004/0257735 | A1 | 12/2004 | Horsky et al. | |
| 2007/0018621 | A1 | 1/2007 | Mok et al. | |
| 2012/0212199 | A1 | 8/2012 | Amer et al. | |
| 2013/0069608 | A1 * | 3/2013 | Gakhar | G05F 1/575 323/273 |

OTHER PUBLICATIONS

Chava et al. "A Frequency Compensation Scheme for LDO Voltage Regulators." IEEE Transactions on Circuits and Systems-I: Regular Papers, 2004, vol. 51. No. 6, pp. 1041-1050 (12 pages).

* cited by examiner

LDO AND LOAD SWITCH SUPPORTING A WIDE RANGE OF LOAD CAPACITANCE

BACKGROUND

A low-dropout (or LDO) regulator is a DC linear voltage regulator, which can operate with a very small input-output differential voltage. The LDO linear voltage regulator is commonly referred to as simply "LDO." The advantages of a low dropout voltage include a lower minimum operating voltage, higher efficiency operation and lower heat dissipation. The main components of a typical LDO linear voltage regulator may include a power FET (e.g., power MOSFET or an equivalent component) and a differential amplifier (i.e., an error amplifier). The FET and the differential amplifier cooperate to regulate the voltage output. The differential amplifier has two inputs: one is used to monitor the output voltage, which is determined by a ratio of two resistors, and the other is a stable voltage reference (a bandgap reference). If the output voltage rises too high relative to the reference voltage, the drive to the power FET changes to maintain a constant output voltage.

LDO architectures are generally categorized into two main categories: LDOs that require an external capacitor and LDOs that do not require an external capacitor. An example of an LDO with an external capacitor is illustrated in FIG. 1, which shows a schematic block diagram of an LDO (low-dropout) linear voltage regulator (100) with high power supply rejection (PSR). As shown in FIG. 1, the feedback network (101), including a resistor divider and an error amplifier (102), regulates the DC output voltage $V_{out}$ to a desired level given by $V_{out}=V_{ref}*(1+R_1/R_2)$. The error amplifier (102) may be a single stage or a multi-stage amplifier. The resistor $R_1$ may be a short circuit, and the resistor $R_2$ may be an open circuit in some architectures. The pass transistor $M_{pass}$ may be either a field effect transistor (FET) or a bipolar transistor, and may be of either n-type or p-type. Multi-stage and high-gain amplifiers are typically used as the implementation of the error amplifier (102) in the feedback network (101). $C_{ext}$ (104) represents a physical external capacitor that is not located inside the same silicon die as the LDO and instead is placed on the printed circuit board (PCB) or inside the microchip package, and $C_L$ (105) represents the load capacitance (without including $C_{ext}$). The supply rejection block (103) is used to enhance the power supply rejection of the LDO (100).

Architectures that require an external capacitor to guarantee the stability of the LDO usually have superior performance over the other type without an external capacitor. These performance parameters include both superior power supply rejection (PSR) and load transient regulation. Power supply rejection is the ability of the LDO to reject any noise coming from the supply through the $V_{in}$ terminal in FIG. 1. Throughout this disclosure, the terms, "power supply," "supply," "$V_{in}$," and "$V_{in}$ terminal" may be used interchangeably to refer to the power source input to a voltage regulator. Further, load transient regulation is the change in the output voltage $V_{out}$ when there is an instantaneous change in the load current, $I_L$. In prior art, LDOs that use external capacitor may achieve PSR of around 56 dB at 10 MHz, and load transient regulation of less than 10 mV when the load current changes from 1 to 100 mA in 1 μsec (with an external capacitance higher than 1 μF). The external capacitor is usually any capacitor that cannot be implemented on the same silicon die where the LDO is implemented.

On the other hand, LDOs that do not require an external capacitor are referred to as capacitor-less LDOs, or capless LDOs. Generally, the capacitor-less LDOs use on-chip capacitors. On-chip capacitors are capacitors that are located in the same silicon die as the LDO. The main advantage of the capacitor-less implementation is that it does not require an external capacitor. This helps to reduce the cost of any device that uses this LDO. Capacitor-less LDOs are used to supply power to multiple circuits inside Systems-On-a-Chip (SOCs), Application Specific Integrated Circuits (ASICs) and microprocessors. These circuits include embedded memories, PLLs, DLLs and high-speed interfaces. The main drawback of capacitor-less LDOs is that both PSR and load transient regulation are much worse than LDOs using external capacitors. Prior art designs reported PSR worse than 50 dB at 1 MHz, and load transient regulation worse than 1V when the load current changes from 1 to 200 mA in 1 μsec. Increasing the load current makes these two parameters even worse. Prior art designs show that increasing the maximum current to 500 mA makes the PSR to be worse than 30 dB at 1 MHz. These two performance parameters show that the capacitor-less LDO cannot be used in many applications that require superior PSR and load transient regulation performance.

FIG. 2 shows a schematic block diagram of a capacitor-less LDO (200) with high PSR (based on the supply rejection block (203)). As noted above, a capacitor-less LDO (200) has degraded performance, as compared to the LDO (100) shown in FIG. 1. The reason for the degraded performance is that the capacitor-less LDO (200) requires that the dominant pole of the open loop transfer function be placed in the feedback network (201), e.g., via the second stage amplifier (204) with the miller capacitor $C_m$ shown in FIG. 2. This technique is widely applied in many capacitor-less LDO, such as the work done by Dow et. al. (U.S. Pat. No. 7,512,909) and Castelli et. al. (U.S. Pat. No. 6,300,749). Generally, the prior art implementations of capacitor-less LDOS place this dominant pole in the feedback loop. Placing the dominant pole in the feedback loop at the output of the error amplifier (202) makes the LDO (200) slower, and thus it does not react fast enough to the load transient variations and the input line variations. In addition, a zero that depends on the load current must be implemented to support a wide range of DC load current. Possible implementations were shown by Castelli et. al. (U.S. Pat. No. 6,300,749), and Gregorius (U.S. Pat. No. 6,700,361 B2). Another drawback of placing the dominant pole in the feedback loop is that this limits the performance of capacitor-less LDOs. For example, the best PSR and load transient regulation that capacitor-less LDOs can achieve, such as the capacitor-less LDO (200), are typically limited to about 40 dB at 1 MHz, and 1V for a step in the load current of 200 mA in 1 μsec, respectively.

Another drawback of many existing capacitor-less LDOs is that they cannot support a wide range of capacitor loads, e.g., from 0 to 10 micro-Farad (10 μF). Prior art capacitor-less LDOs typically become unstable (e.g., the LDO output would oscillate) if the output capacitor exceeds 1 nano-Farad (1 nF). On the contrary, prior art LDOs that require external capacitors cannot be used when the load capacitance is lower than 0.1 μF (e.g., the LDO output would oscillate). Accordingly, there is a need for an LDO that can support a wide range of load parameters. These load parameters include load capacitances ranging from 0 to 10 μF and load resistances ranging from infinity (zero or no load current) to the maximum allowed current.

A load switch regulator has substantially the same structure as an LDO voltage regulator. The main difference between an LDO and a load switch regulator is the reference voltage ($V_{ref}$). In the case of LDO voltage regulator, $V_{ref}$ is supply independent and usually generated from a bandgap reference voltage circuit. In the case of the load switch regulator, $V_{ref}$ is a scaled (and filtered) version of the DC value of the supply. Thus, the DC level of the output voltage $V_{out}$ changes proportionally with the DC level of the input voltage $V_{in}$. Accordingly, the block diagrams shown in FIGS. 1 and 2 may also be used to represent a load switch regulator with an external capacitor and a load switch regulator without an external capacitor (i.e., a capacitor-less load switch regulator), respectively. Similar to the capacitor-less LDO voltage regulators, capacitor-less load switch regulators typically have a limited PSR and load transient regulation of about 50 dB at 1 MHz, and 1V for a step in the load current of 200 mA in 1 μsec, respectively. Throughout this disclosure, the terms "load switch regulator," "load switch linear voltage regulator," and "load switch" may be used interchangeably. Further, the term "LDO/load switch linear voltage regulator" refers to either an LDO or a load switch depending on specific configurations of the reference voltage used.

A controlled startup is one of the main challenges and requirements in voltage regulators. Voltage overshoots and rush-in currents can cause damage to the load and to voltage regulator components. Multiple soft-start and voltage clamp techniques have been used and introduced in the prior art. All these techniques are load independent and lead to a non-optimized performance. For example, prior art (e.g. US2004/0257735A1) typically senses the load resistance by sensing the load current and re-adjusts the loop dynamics based on the average load current. The same circuits can be used for over-current protection and to indirectly control the circuit heat and safety. Finally, prior art capacitor sensing circuits in applications such as CMOS sensor are also presented.

For example, US2013/0069608A1 discusses a prior art analog circuit to detect the capacitor load range during startup. It charges an internal capacitor and discharges it using a current source. This results in a constant rate of change of the voltage across the capacitor which leads to a transient capacitor current flowing into the output capacitor (CL), and this transient current is proportional to the CL value. By detecting this current value with a current sensing circuit, the output capacitor value can be estimated. This method can be used for known values of load resistors or for open circuit operation during startup. Output voltage monotonicity is not guaranteed with this solution.

US2004/0257735A1 presents another prior art analog circuit that is used to detect an output resistor range by charging and discharging the output node through a source current and a sink current. Using a two-comparator setup, a min-max range of the load resistor can be estimated. More levels of accuracy can only be achieved with more comparators leading to large area and cost which may not be a suitable solution for many applications.

While the prior art approaches are useful, there is still a need for better load detection circuits and for better LDOs, which may include load detection circuits.

SUMMARY

In general, in one aspect, the invention relates to a novel architecture and method to maintain stability of a low drop-out (LDO)/load switch linear voltage regulator (LVR). In accordance with some embodiments of the invention, an architecture and method may also support optionally determining, during a power-up phase and by using a load detection circuit, an estimate of the load parameters that represent: the load time constant and the load resistor at an output node of the LDO/load switch LVR, and adjusting, based on the estimated load parameters, an adaptive RC network in the LDO/load switch LVR, wherein the adaptive RC network produces an adaptive zero in a feedback network transfer function of the LDO/load switch LVR, adjusts the turn-on time of the LVR, and detects if there is a short circuit at the output node, wherein the adaptive zero reduces an effect of a non-dominant pole in the open loop transfer function of the LDO/load switch LVR, and wherein a frequency of the adaptive zero is adjusted based on the load parameters.

In one aspect, embodiments of the invention relate to low drop-out (LDO) load switch linear voltage regulator (LVR) circuits having an open loop transfer function. In accordance with one embodiment of the invention, an LVR circuit comprises a feedback network and a pass transistor, wherein the feedback network comprises a first input coupled to an output of the LVR circuit, a second input coupled to a reference voltage, and an output, and wherein the pass transistor that includes a gate terminal driven by the output of the feedback network, a first terminal coupled to an input of the LVR circuit, and a second terminal coupled to the output of the LVR circuit; and wherein the feedback network further comprises an output scaling network, an error amplifier, a first buffer, a second buffer and a capacitor.

In accordance with some embodiments of the invention, an LDO/load switch LVR circuit may include a pass transistor device configured to generate a Vout output from a Vin input, and a feedback control circuit coupled to the pass transistor device and configured to adjust a gate control signal supplied to the pass transistor device for regulating a voltage level of the Vout output, wherein the gate control signal is adjusted based on a difference between a reference voltage signal and a sample of the voltage level of the Vout output, wherein the feedback network is configured to place a dominant pole at the Vout output without using an external capacitor.

In accordance with embodiments of the invention, the feedback network is configured to regulate an output voltage level of the output of the LVR circuit based on the reference voltage, and the pass transistor comprises at least one selected from a group consisting of an n-type field effect transistor, a p-type field effect transistor, and a bipolar junction transistor.

In accordance with any of the above embodiments, the LVR circuit may optionally comprise a load detection circuit. The load detection circuit may comprise an input coupled to the output of the LVR circuit, and an output coupled to the feedback network. The load detection circuit may be configured to estimate a load parameter that represents at least one selected from the group consisting of: a load time constant and a load resistor at the output of the LVR circuit; and to generate a control signal to adjust at least one circuit parameter of the feedback network to prevent any oscillation at the output of the LVR circuit over a plurality of pre-determined load conditions.

In accordance with any of the above embodiments, the LVR circuit may remain stable over a plurality of capacitive load conditions ranging from no capacitive load to a 10 μF load.

In accordance with any of the above embodiments, a dominant pole of the open loop transfer function of the LVR circuit is at the output of the LVR circuit over a predetermined frequency range and a plurality of pre-determined load conditions. The dominant pole of the open loop transfer function of the LVR circuit is at the output of the LVR.

In accordance with any of the above embodiments, in the LVR circuit, the first buffer may comprise an input coupled to the output of the error amplifier and an input of the second buffer; and an output coupled to a first terminal of the capacitor.

In accordance with any of the above embodiments, in the LVR circuit, the error amplifier may comprise a first input for receiving a reference voltage; and a second input coupled to an output of the resistive divider.

In accordance with any of the above embodiments, in the LVR circuit, the capacitor may comprise a first terminal connected to the output of the first buffer; and a second terminal connected to the output of the LVR.

In accordance with any of the above embodiments, in the LVR circuit, the second buffer may comprise an output driving a gate terminal of the pass transistor.

In accordance with any of the above embodiments, in the LVR circuit, the output scaling network may comprise an input connected to the output of the LVR, and the output connected to the second input of the error amplifier, wherein the output scaling network is configured to scale down an output voltage level of the LVR, using a resistive divider.

In accordance with any of the above embodiments, in the LVR circuit, the first buffer is configured to isolate the output of the error amplifier from being affected by load current variations of the LVR circuit; and add a zero to the open loop transfer function of the feedback network to reduce an effect of a non-dominant pole of the open loop transfer function.

In accordance with any of the above embodiments, in the LVR circuit, the second buffer is configured to increase a gain of the feedback network and for driving the pass transistor.

In accordance with any of the above embodiments, the LVR circuit may further comprise a zero generation circuit configured to generate a zero, wherein the input of the first buffer is coupled to the output of the error amplifier and the input of the second buffer via the zero generation circuit. The zero generation circuit comprises an adaptive RC network forming a low pass filter, and wherein a time constant of the adaptive RC network is controlled by a load detection circuit based on an estimated value of a load parameter. The adaptive RC network comprises at least one selected from a group consisting of a variable capacitor and a variable resistor controlled by the load detection circuit block based on the estimated load parameters that represent at least one selected from the group consisting of: a load time constant of an output voltage and a load resistor.

In accordance with any of the above embodiments, the load detection circuit may comprise a current source, an amplifier, and a decision circuit configured to generate a count proportional to a time period for the current source to charge the load parameter for the output of the LVR circuit to reach the constant voltage. The current source may comprise a first terminal coupled to the output of the LVR circuit; and a second terminal coupled to a fixed potential node. The amplifier may comprise a first input coupled to the output of the LVR circuit; and a second input coupled to a constant voltage.

In accordance with any of the above embodiments, the LVR circuit may further comprise a chip controller configured to activate the load detection circuit block during a power up phase of the LVR circuit; and de-activate the load detection circuit block subsequent to the power up phase of the LVR circuit.

In accordance with any of the above embodiments, the load detection circuit is configure to output a count representing an estimated load parameter that indicates if there is a short circuit at the output node of the LVR.

In accordance with any of the above embodiments, the LVR circuit may further comprise a supply rejection circuit configured to inject input ripples into the LVR circuit to reduce an overall effect of the input ripples.

In accordance with any of the above embodiments, the pass transistor device is configured to generate a $V_{out}$ output from a $V_{in}$ input; and the feedback network is coupled to the pass transistor device and configured to adjust a gate control signal supplied to the pass transistor device for regulating a voltage level of the $V_{out}$ output, wherein the gate control signal is adjusted based on a difference between a reference voltage signal and a sample of the voltage level of the $V_{out}$ output. The feedback network may be configured to place a dominant pole at the $V_{out}$ output without using an external capacitor.

In accordance with any of the above embodiments, the LVR circuit may further comprise a load detection circuit configured to estimate the output load parameters that represent at least one selected from a group consisting of: the load time constant and the load resistor at the $V_{out}$ output, wherein the feedback control circuit is adjusted based on the estimated output load parameters.

In one aspect, embodiments of the invention relate to methods for adjusting stability of a low drop-out (LDO)/load switch linear voltage regulator (LVR) having an open loop transfer function. A method in accordance with one embodiment of the invention comprises determining, during a power-up phase and by a load detection circuit, an estimated output load parameter that represents at least one selected from a group consisting of: a load time constant and a load resistor value at an output node of the LDO/load switch LVR; and adjusting, based on the estimated output load parameter, an adaptive RC network in the LDO/load switch LVR. The adaptive RC network produces an adaptive zero in a feedback network transfer function of the LDO/load switch LVR, and the adaptive zero reduces an effect of a non-dominant pole in the open loop transfer function of the LDO/load switch LVR.

In accordance with any of the above embodiments of the invention, a method may further comprise estimating the output load parameter that represents at least one selected from a group consisting of: the load time constant and the load resistor value while the LDO or load switch LVR is in an off state or while the LDO or load switch is in a power-up state, and wherein the LDO/load switch LVR remains stable over a plurality of capacitive load conditions ranging from no capacitive load to a 10 μF load.

In accordance with any of the above embodiments of the invention, a method may further comprise adjusting the adaptive RC network while estimating the output load parameters. The adjusting the adaptive RC network involves selecting the frequency of the adaptive zero to reduce phase margin degradation due to the non-dominant pole of the open loop transfer function of the LDO/load switch LVR.

In another aspect, embodiments of the invention relate to load detection circuits for a low drop-out (LDO) load switch linear voltage regulator (LVR) with a start-up behavior. A load detection circuit in accordance with one embodiment of the invention may comprise a measurement circuit for generating a value representing at least one selected from a group consisting of: the time constant of the output voltage, the load resistor, and the load capacitor connected to the output of the voltage regulator before startup; and a control circuit that optimizes, based on the value, the startup behavior by controlling the output current of the voltage regulator.

In accordance with any of the above embodiments of the invention, a load detection circuit may further comprise a charging circuit coupled to the regulator output node and configured to charge the output node; a variable gain amplifier (VGA) coupled to the regulator output node and configured to detect the output voltage level, and a decision circuit coupled to the output of the variable gain amplifier (VGA) and configured to generate outputs that are proportional to load parameters.

In accordance with any of the above embodiments of the invention, in a load detection circuit, the VGA gain value may be proportional to the output voltage value and thus to the output resistor value, wherein the decision circuit generates an output signal related to the to the charge time and to the output time constant.

Other aspects of the invention will be apparent from the following description and the appended claims.

BRIEF DESCRIPTION OF DRAWINGS

The appended drawings illustrate several embodiments of the invention and are not to be considered limiting of its scope, for the invention may admit to other equally effective embodiments.

DETAILED DESCRIPTION

Figure 1:
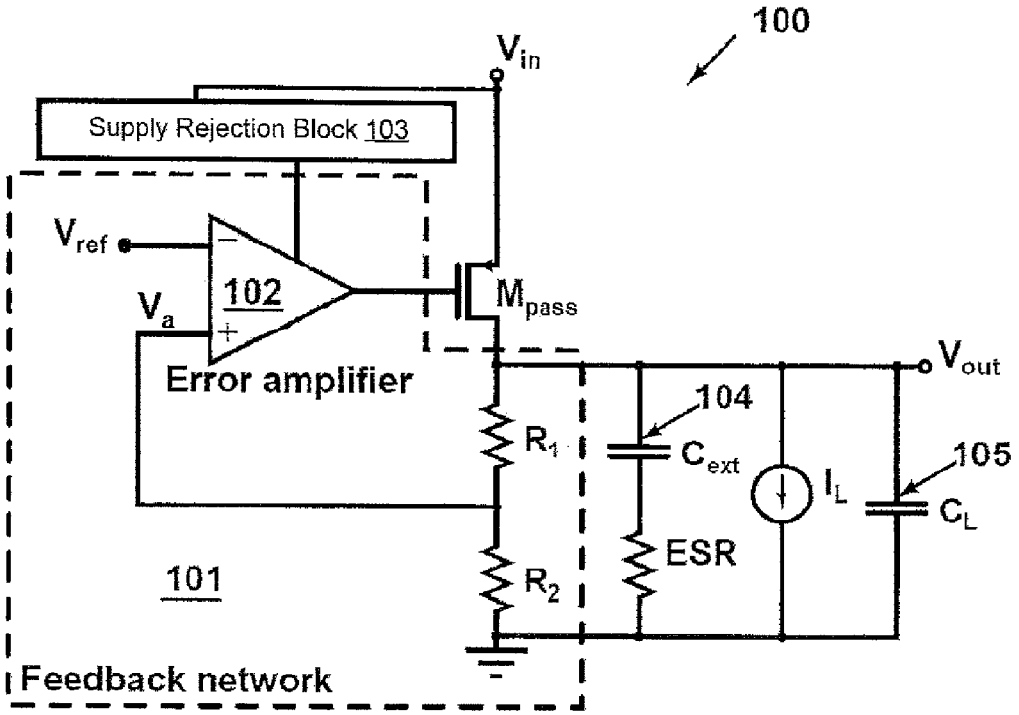
FIG. 1 Prior Art
FIG. 1 shows a schematic block-level circuit diagram of an LDO/load switch linear voltage regulator, in which embodiments of the invention may be implemented.

Aspects of the present disclosure are shown in the above-identified drawings and described below. In the description, like or identical reference numerals are used to identify common or similar elements. The drawings are not necessarily to scale and certain features may be shown exaggerated in scale or in schematic in the interest of clarity and conciseness.

Embodiments of the invention relate to a capacitor-less LDO and/or load switch linear voltage regulator with an improved architecture that is capable of driving a wide load capacitance range, such as from 0 to 10 micro-Farads (10 μF), while achieving improved power supply rejection and load transient regulation. In one or more embodiments of the invention, the improved LDO/load switch architecture, for example, may achieve PSR better than 45 dB at 10 MHz for load currents higher than 500 mA, and load transient regulation better than 60 mV for a step in the load current from 0 mA to 200 mA in 1 μsec without an external capacitor. In addition, embodiments of the invention may also be used with an external capacitor. Power supply rejection and load transient regulation are even better if an external capacitor is used.

As noted above, controlled startup is one of the main challenges and requirements in voltage regulators. Voltage overshoots and rush-in currents can cause damage to the load and to voltage regulator components in LDOs. In the prior art, multiple soft-start and voltage clamp techniques have been used to minimize these problems. However, these prior art techniques are load independent and lead to a non-optimized performance. Knowledge of the load parameters (e.g. load resistance (R), load capacitance (C) and load time constant) and initial output voltage before startup can help control the startup operation and provide a monotonic output voltage.

Some embodiments of the invention optionally use these load parameters to control the voltage regulator output current in order to produce a controlled startup. Specifically, in accordance with embodiments of the invention, a novel load detection circuit may be included to detect the resistor load range and the load time constant range during a monotonic startup procedure with accurate resolution and without requiring a large increase in hardware size or silicon area. The circuit may also include an inherent short-circuit detection. Adding this circuit to an LDO or to a Load Switch and using its output to adjust the loop dynamics, results in a load-aware LDO or a load-aware Load Switch that works for an extended range of load parameters The following description of embodiments of the invention will be illustrated using capacitor-less LDOs as examples. However, those skilled in the art, with the benefit of this disclosure, will appreciate that same or similar features are equally applicable to the load switch as well.

In one or more embodiments, the LDO linear voltage regulator with an improved feedback network may be implemented on a microchip, such as a semiconductor integrated circuit. As noted above, capacitor-less LDO voltage regulators do not require an external capacitor. In particular, many prior art capacitor-less LDOs fail to function properly with any external capacitor. In one or more embodiments, the improved capacitor-less LDO may function properly with or without an external capacitor. Throughout this disclosure, the terms "LDO," "LDO linear voltage regulator," "capacitor-less LDO," "improved capacitor-less LDO," and "LDO linear voltage regulator with an improved feedback network" may be used interchangeably depending on the context.

In one or more embodiments, an improved capacitor-less LDO linear voltage regulator has a dominant pole at the LDO output node (i.e., the $V_{out}$ terminal), instead of having the dominant pole in the feedback network. As noted above, the dominant pole of an example prior art capacitor-less LDO solution is placed at the output of the error amplifier (e.g., the error amplifier (202) depicted in FIG. 2 above). Placing the dominant pole at the LDO output node increases the speed of the feedback network such that the LDO reacts to load current variations and supply noise variations with improved response time. This leads to better PSR and transient load regulation. In one or more embodiments, placing the dominant pole at the LDO output node allows for the use of an additional external capacitor to achieve better performance parameters. For example, this approach may allow for the use of an optional external load capacitance in the range from 0 to 10 μF. Typically, forcing the LDO output node to be the dominant pole in capacitor-less LDO solutions requires a large output capacitor that cannot be integrated on the same silicon die. Embodiments of the invention use a particular circuit configuration shown in FIG. 3 to overcome this issue.

Figure 3:
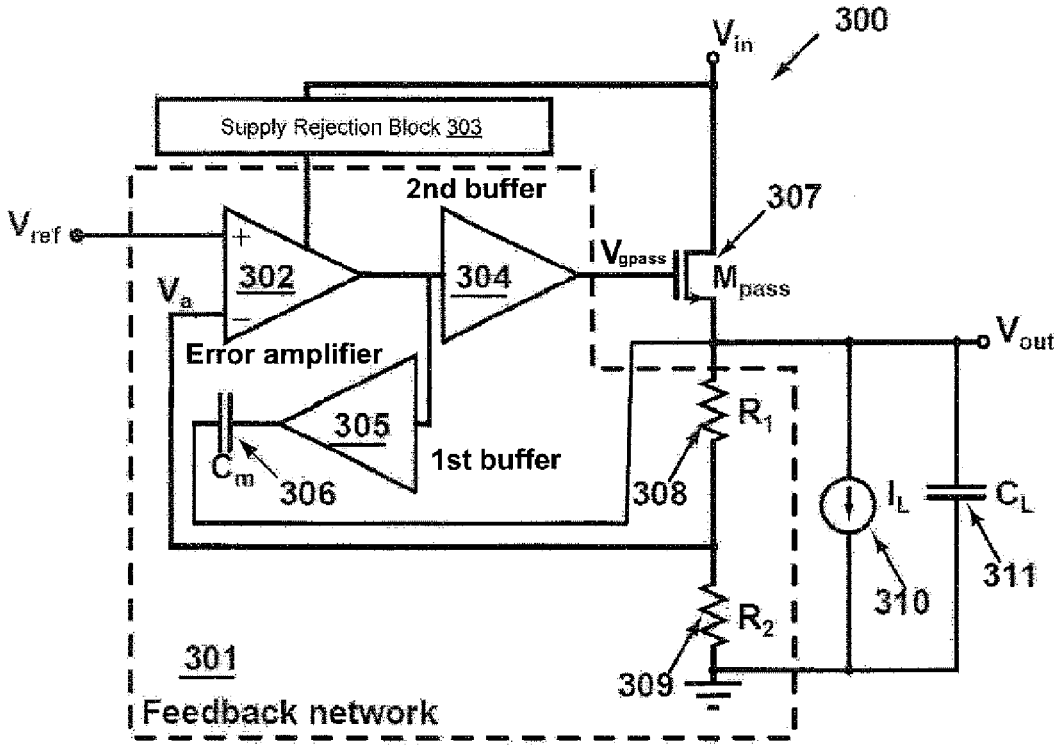
FIG. 3 shows a schematic block-level circuit diagram of a capacitor-less LDO/load switch linear voltage regulator in accordance with embodiments of the invention.

FIG. 3 shows a schematic block-level circuit diagram of an improved capacitor-less LDO (300) that includes a feedback network (301) (including an error amplifier (302) (e.g., a single or multi-stage amplifier), a capacitor $C_m$ (306), a second voltage buffer (304), a first voltage buffer (305), and a resistive divider network formed by a resistor (308) and a resistor (309)), a pass transistor device $M_{pass}$ (307), a supply rejection block (303), and a load capacitor $C_L$ (311). In addition, the current source $I_L$ (310) represents a load current of the improved capacitor-less LDO (300). In particular, the improved capacitor-less LDO (300) is essentially the same as the LDO (100) where the feedback network (101) is implemented using an improved feedback network described below to eliminate the need of the external capacitor $C_{ext}$ (104) shown in FIG. 1. Although the pass transistor device (307) is shown in FIG. 3 as an NMOS transistor, other types of the devices, such as PMOS transistor, NPN or PNP bipolar junction transistors may also be used. In one or more embodiments, the error amplifier (302) may be a single-stage amplifier or a multi-stage amplifier, and one or more of the second voltage buffer (304) and the first voltage buffer (305) may provide a gain or attenuation. In one or more embodiments of the invention, one or more of the modules and elements shown in FIG. 3 may be omitted, repeated, and/or substituted. Accordingly, embodiments of the invention should not be considered limited to the specific arrangements of modules shown in FIG. 3.

In one or more embodiments, forcing the dominant pole at the output of the improved capacitor-less LDO (300) is achieved by amplifying the value of the capacitor $C_m$ (306) with the gain of the error amplifier (302). Depending on the gain, the capacitor $C_m$ (306) may have an equivalent capacitance (referred to as the effective output capacitance) at the output node $V_{out}$ that is much higher than the value of $C_m$ (306). Specifically, the effective output capacitance is $C_m*A_e$, where $A_e$ is the gain of the error amplifier (302). For example, a 100 pico-Farad (pF) capacitor (i.e., $C_m$ (306)) across an amplifier (i.e., error amplifier (302)) with a gain of 10000 is equivalent to an effective load capacitance of 1 μF at the output node (i.e., $V_{out}$ terminal of the capacitor-less LDO (300)). The 1 μF is comparable to the external capacitors used for the LDOs that require an external capacitor to operate. Thus, the improved capacitor-less LDO (300) has an effective output capacitance that is similar to the LDO architectures requiring an external capacitor. Accordingly, the need for an external capacitor is eliminated in the improved capacitor-less LDO (300) and the cost of the overall system is reduced.

In one or more embodiments, the first voltage buffer (305) is used to isolate the output node of the error amplifier (302) such that it is not affected by the variations in the load current $I_L$ (310) to achieve better load transient regulation. Also, the first voltage buffer (305) introduces a zero to cancel one of the non-dominant poles. In one or more embodiments, the second voltage buffer (304) is used to drive the large parasitic capacitance introduced by the pass transistor device $M_{pass}$ (307). Although the second voltage buffer (304) and the first voltage buffer (305) are used to achieve better load transient regulation and PSR performances, in one or more embodiments, the second voltage buffer (304) and the first voltage buffer (305) may not be required for forcing the dominant pole at the output of the capacitor-less LDO (300). In one or more embodiments, the improved capacitor-less LDO (300) may support load capacitances ranging from 0 to 10 nF.

Figure 4:
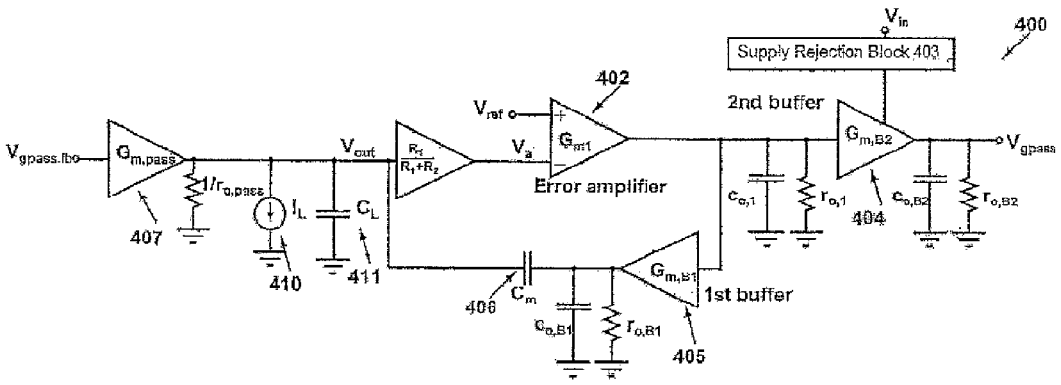
FIG. 4 shows a schematic block-level circuit diagram, in the open loop configuration, of a capacitor-less LDO/load switch linear voltage regulator in accordance with embodiments of the invention.

FIG. 4 shows a schematic block-level circuit diagram, in the open loop configuration, of an improved capacitor-less LDO linear voltage regulator (400). In one or more embodiments, the terminals $V_{gpass}$ and $V_{gpass,fb}$ of the LDO (400) are connected together to thug a closed loop configuration similar to the LDO (100) shown in FIG. 1 or the improved capacitor-less LDO (300) shown in FIG. 3. Specifically, with the exception of being shown in the open loop configuration, the improved capacitor-less LDO (400) is essentially the same as the improved capacitor-less LDO (300) with output resistances/capacitances of various amplifier/buffer elements explicitly shown as circuit elements. In other words, as shown in FIG. 4, the error amplifier (402), the supply rejection block (403), the second voltage buffer (404), the first voltage buffer (405), the pass transistor device (407), the load current (410), and the load capacitor (411) are equivalent to the error amplifier (302), the supply rejection block (303), the second voltage buffer (304), the first voltage buffer (305), the pass transistor device (307), the load current (310), and the load capacitor (311), respectively, shown in FIG. 3. Furthermore, as shown in FIG. 4, the error amplifier (402), the first voltage buffer (405), and the second voltage buffer (404) are referred to as the transconductance amplifiers $G_{m1}$, $G_{m,B1}$, and $G_{m,B2}$, respectively. Furthermore, $r_{o1}$, $r_{oB1}$, and $r_{o,B2}$ represent equivalent resistances at the output nodes of the transconductance amplifiers $G_{m1}$, $G_{m,B1}$, and $G_{m,B2}$, respectively. Further still, $c_{o1}$, $c_{o,B1}$, and $C_{o,B2}$ represent equivalent capacitances at the output nodes of the transconductance amplifiers $G_{m1}$, $G_{m,B1}$, and $G_{m,B2}$, respectively.

Mathematical analysis shows that the open loop transfer function from $V_{gpass,fb}$ to $V_{gpass}$ is given by $TF=(V_{gpass}/V_{gpass,fb})=A_0(1+s/\omega_{cz})/(1+\beta_1 s+\beta_2 s^2+\beta_3 s^3)=(1+s/\omega_{cz})/[(1+s/\omega_{p1})(1+s/\omega_{p2})(1+s/\omega_{p3})]$, where $A_0$ is the DC gain, $\omega_{cz}$ is a zero, $s=j\omega$, $\omega$ is the frequency in radians, and $\beta_1$, $\beta_2$, and $\beta_3$ are the coefficients responsible for the dominant and non-dominant poles, given by $\omega_{p1}$, $\omega_{p2}$, and $\omega_{p3}$, in the transfer function. $A_0$, $\omega_{cz}$, $\beta_1$, $\beta_2$, and $\beta_3$ are functions of the circuit element values in FIGS. 3 and 4. As is known to those skilled in the art, a pole or a zero of a transfer function (e.g., $V_{gpass}/V_{gpass,fb}$) refers to a frequency at which the transfer function becomes infinity or zero, respectively. The pole frequency is usually approximated by the product of total resistance to ground and total capacitance to ground at any circuit node. In this context, the pole is said to be placed at the circuit node. The main limitation is that the non-dominant pole, $\omega_{p3}$, introduced by coefficient $\beta_3$ starts to move lower in frequency as the value of the load capacitance $C_L$ (411) and load resistance denoted by $I_L$ (410) increase. Therefore, the stability of the improved capacitor-less LDO (400) at different load capacitance and resistance is affected. This happens because the coefficient $\beta_3$ is proportional to the load time constant composed of the product of capacitance $C_L$ (411) and load resistance denoted by $I_L$ (410). As the time constant increases in value, $\beta_3$ increases resulting in the non-dominant pole moving lower in frequency, and thus limiting the maximum value of the load capacitance $C_L$ (411) and load resistance. In one or more embodiments, the maximum value of the load capacitance $C_L$ (411) may be limited to 10 nF and the load resistance may be limited to 100 KΩ.

Figure 2:
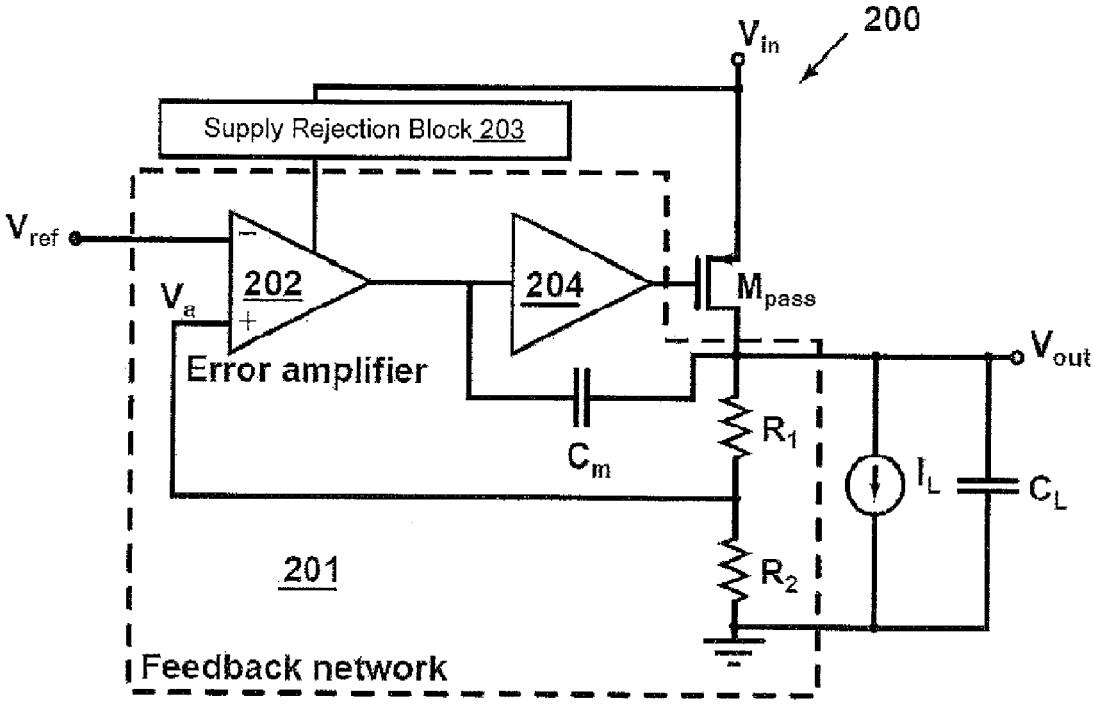
FIG. 2 Prior Art
FIG. 2 shows a schematic block-level circuit diagram of a typical prior art capacitor-less LDO/load switch linear voltage regulator.
Figure 5:
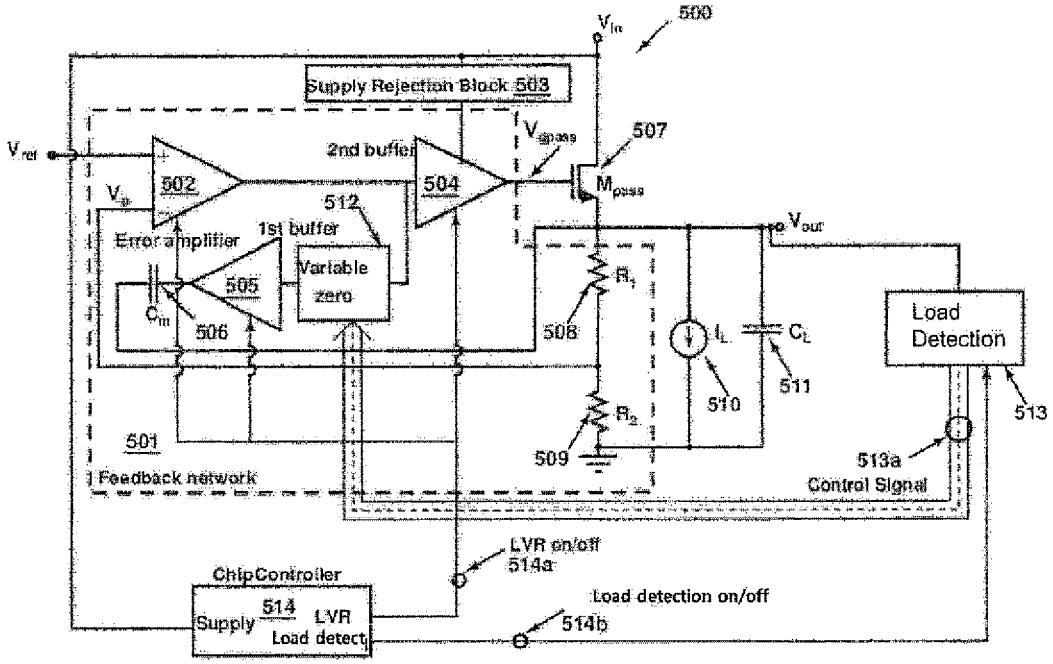
FIG. 5 shows a schematic block-level circuit diagram of a capacitor-less LDO/load switch linear voltage regulator with an optional load detection circuitry in accordance with embodiments of the invention.

The aforementioned limitation of the circuit of FIG. 3 can be relieved using either of the following two approaches: 1) through circuit level optimization of the key blocks and parameters of the embodiment shown in FIG. 3, or 2) by adding an optional load detection scheme illustrated in FIG. 5 to adjust the internal parameters of the LDO. These circuit elements could be either on and/or off the same chip including the capacitor-less LDO. The load detection approach can be applied to the existing LDO architectures, and is not limited to the circuit shown in FIG. 3. Using the two optimization approaches, the LDO of FIG. 3 is able to support a wide range of load parameters.

FIG. 5 shows an improved capacitor-less LDO linear voltage regulator (500) that further comprises an additional load detection circuitry to support a wide range of load capacitances from 0 to 10 μF and load resistance from infinity down to the maximum allowed load current. The load detection can optionally help to detect a short circuit condition before powering up the LDO or while the LDO is powering up, and it can also optionally help enhance some LDO performance parameters such as soft-start and stability. In this example, the load detection circuitry includes three circuit blocks, namely a chip controller block (514), a load detection block (513), and a variable zero block (512). The remaining elements of the improved capacitor-less LDO (500) are essentially the same as corresponding elements shown in FIG. 3. Specifically, as shown in FIG. 5, the error amplifier (502), the supply rejection block (503), the second voltage buffer (504), the first voltage buffer (505), the pass transistor device (507), the load current (510), and the load capacitor (511) are equivalent to the error amplifier (302), the supply rejection block (303), the second voltage buffer (304), the first voltage buffer (305), the pass transistor device (307), the load current (310), and the load capacitor (311), respectively, shown in FIG. 3 above. Further, the error amplifier (502), the second voltage buffer (504), and the first voltage buffer (505) can be turned off by a LVR on/off signal (514*a*). In one or more embodiments, the feedback network (501) may be a combination of the feedback network (301) and the variable zero block (512). In one or more embodiments, the optional load detection block (513) may be used to initially estimate the load parameters that represent at least one selected from a group consisting of the load time constant and the load resistor denoted by IL (510) before the improved capacitor-less LDO (500) starts supplying the load current (510). In case of the short circuit load, the load detection circuit does not turn on the LVR, and thus it protects it from being damaged.

In one or more embodiments, the load detection block (513) includes a charging circuit, a Variable Gain amplifier (VGA), a state machine, and a decision circuit. The decision circuit contains a comparator, a counter, and a clock generator. In each clock cycle the counter increments its count by one. The charging circuit initially starts to charge the output node of the LVR Vout. As a result, the output voltage $V_{out}$ starts to increase with time. At the same time, the counter is incrementing its output once every clock cycle. Once the output voltage $V_{out}$ reaches a pre-specified value, the counter stops counting and records its final count. The final count is proportional to load parameters (the load time constant and the load resistor denoted by $I_L$ (510). During the load detection phase, the $M_{pass}$ (507) is switched off. Once the load parameters are estimated, a control signal (513*a*) is generated by the load detection block (513) to control the variable zero block (512). This control signal (513*a*) may be an analog signal or a digital signal (e.g., a digital word pattern). In response, the variable zero block (512) introduces a zero (referred to as an adaptive zero) in the transfer function ($V_{gpass}/V_{gpas,fb}$) to reduce or cancel the effect of the unwanted pole $\omega_{p3}$ having a changing value affected by the estimated load parameters. The modified transfer function ($V_{gpass}/V_{gpas,fb}$) can be approximated by $TF \cong (1+s/\omega_{cz})(1+s/\omega_{cz2})/[(1+s/\omega_{p1})(1+s/\omega_{p2})(1+s/\omega_{p3})]$, where $\omega_{cz2}$ is the zero introduced by the variable zero block (512). In one or more embodiments, the variable zero block (512) includes a resistance-capacitance network, wherein the control signal (513*a*) changes the value of the resistance and/or the capacitance of the resistance-capacitance network. The variable zero block (512) may be first order low pass filter (LPF) based on a single resistance and capacitance. The input terminal of variable zero block (512) is the input of LPF and the output terminal of the variable zero block (512) is the output of the LPF. The frequency of the adaptive zero may be adjusted by changing either the value of the resistance or the capacitor in the LPF. In one or more embodiments, the frequency of the adaptive zero is dependent on the estimated load parameters to reduce phase margin degradation due to at least one non-dominant pole (e.g., $\omega_{p3}$) of the open loop transfer function of the LDO/load switch LVR. As a result, the LDO linear voltage regulator (500) remains stable over a number of capacitive load conditions ranging from no capacitive load to a 10 μF load.

Figure 6:
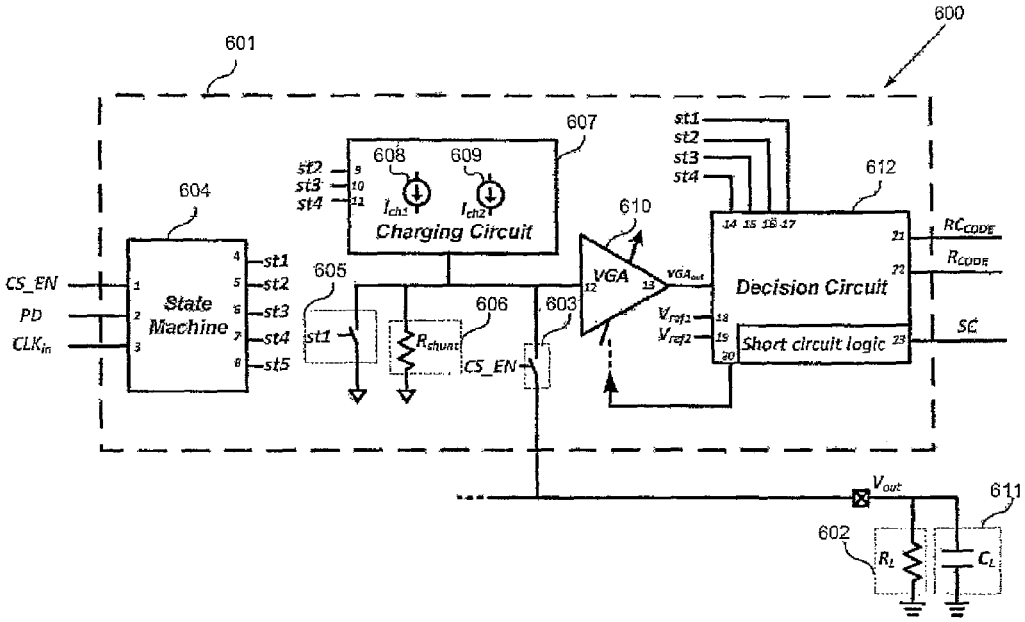
FIG. 6 shows the block diagram of a load detection circuit based on the current innovation.

The load detection circuit uses different sequential phases in order to estimate the critical load parameters. These phases are: 1) Initial charging phase, 2) Load estimation phase, 3) Second charging phase, and 4) RC time constant estimation phase. FIG. 6 shows a block diagram of a load detection circuit (601). In one or more embodiments of the invention, one or more of the modules and elements shown in FIG. 6 may be omitted, repeated or substituted. Accordingly, embodiments of the invention should not be considered limited to the specific arrangements of modules shown in FIG. 6.

In one or more embodiments, the load detection circuit (601) includes a switch (603) to connect the load detection circuit to the LVR (or Load switch) load during startup only and disconnect it during normal operation. It may also include a switch (605) to discharge the output node (Vout) initially.

In one or more embodiments, the load detection circuit (601) includes state machine (604) and it is designed to control the states of operation in a sequential fashion.

In one or more embodiments, the load detection circuit (601) includes a charging circuit (607) that is composed of two current sources (608) and (609) that can be switched ON and OFF in different states for proper operation.

In one or more embodiments, the load detection circuit (601) includes an optional shunt resistor (Rshunt) (606) to limit the voltage at the output node (Vout) during load detection irrespective of the load resistance (RL).

In one or more embodiments, the load detection circuit (601) includes a variable Gain Amplifier (VGA) (610) designed to estimate its input voltage level, after charging the output node (Vout).

In one or more embodiments, the load detection circuit (601) includes a decision circuit (609) to calculate the load parameters and control the VGA (610) gain steps. The decision circuit includes a circuitry which controls the comparison of VGA output (VGAout, which is an amplified version of the LDO output) with two reference voltages (Vref1 and Vref2) at different times, and based on the results of these comparisons the decision circuit is able to compute different load parameters including the load resistor (R), the load time constant (RC) and any short circuit condition (SC).

As shown in FIG. 6, the load detection circuit has a main switch (603) that is controlled by the main enable signal of the voltage regulator (CS_EN). This switch is turned ON during the circuit operation to access the load point (Vout). Then, it is turned OFF as soon as it collects the required load information, so that the detection circuit is masked during the regulator normal operation.

Further, as shown in FIG. 6, a state machine (604) is used to control the sequential operation of the load detection circuit. In one example, the state machine (604) may have three inputs: a) CS_EN: that controls the ON/OFF operation of the detection circuit, b) PD: Master power down of the whole IP, and c) CLKin: a clock input to be used in synchronous state machines. Asynchronous state machine can be implemented, where a clock is not needed, but it can suffer from random or systematic glitches. The state machine generates several non-overlapping signals, each corresponding to an active state. FIG. 6 shows an example with five (5) non-overlapping signals and five (4) state-machine states but other number of states can be used. St1, St2, St3, St4, and St5 are active in state1, state2, state3, state4 and state5 respectively.

Figure 7:
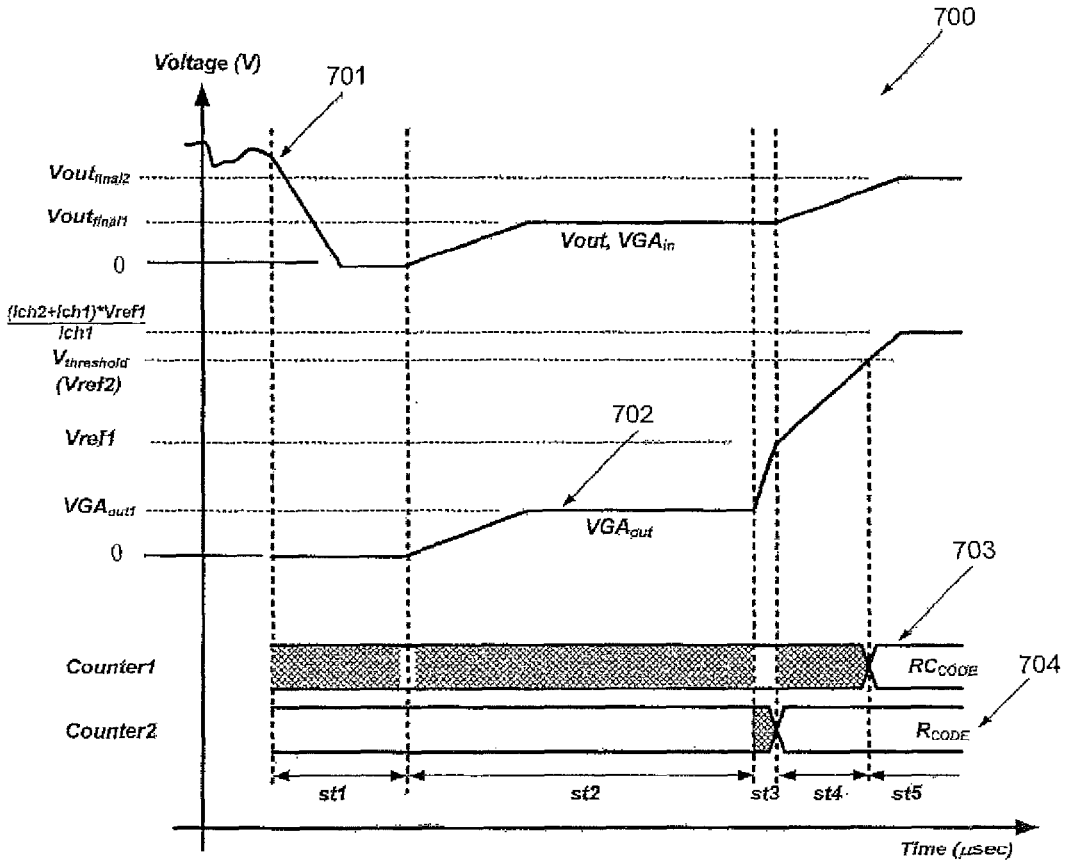
FIG. 7 shows the timing diagram for the load detection circuit with the critical voltage signals and circuit output.

FIG. 7 shows the timing diagram with the critical signals. During state1 (st1), the output node is discharged to zero to set a proper initial condition. This is performed through a grounded switch (605). After proper discharge, switch (605) turns OFF leaving a floating output node (Vout). During state2 (st2), the current source Ich1 (608) is enabled to charge the output node for a fixed time. The output node reaches a value ($Vout_{final1}$) as shown in FIG. 7. This value depends on the parallel combination of $R_{shunt}$ (606) and RL (602). Thus, the RL value is stored in $Vout_{final1}$. $R_{shunt}$ is added to limit ($Vout_{final1}$).

In state3 (st3), a digitally controlled Variable Gain Amplifier (610) is enabled and its gain starts to increase in steps controlled by the decision circuit (609). As a result, the VGA output level increases in steps, since its input is maintained fixed at a value of $Vout_{final1}$. This process continues until the VGA output reaches the Vref1 reference voltage. When this event is detected by the decision circuit, the VGA gain setting is stored as $R_{code}$. $R_{code}$ represents the required gain for $V_{outfinal1}$ to reach Vref1. Thus, the resistor RL (602) information is stored in $R_{code}$. The VGA gain is fixed for the rest of the operation. The required resolution of the RL estimation determines the number of gain steps of the VGA. The higher the number of gain steps, the higher the resolution of RL estimation.

Knowing that the lower the value of RL, the lower $Vout_{final1}$, the higher the required gain, and thus the higher $R_{code}$; a short-circuit logic is simply added at this phase, where an upper threshold of $R_{code}$ indicates a lower threshold of RL (short circuit threshold). As soon as $R_{code}$ reaches this threshold, the short-circuit logic flags indicating an RL below the minimum required load conditions.

During state4 (st4), another current source Ich2 (609) is enabled to charge the output node further more to reach $Vout_{final2}$. The ratio between $Vout_{final2}$ to $Vout_{final1}$, is the ratio between (Ich2+Ich1) to (Ich1). The same ratio applies at the VGA output. Thus, the final value of $VGA_{out}$ is defined. Calculating the time taken for $VGA_{out}$ to be charged, from Vref1 to a certain threshold (Vref1), gives an estimate of the load time constant ((RL)×(CL)) (602 and 611) and stores it in the $RC_{code}$. This is performed by the decision circuit (609).

During state5 (st5), both $R_{code}$ and $RC_{code}$ are available. Using simple logic operations, a reasonable estimate of RL, CL and the time constant can be derived.

Values of RL and RC time load parameters are then used to control the LVR (or Load Switch) output current to achieve the required monotonic controlled output voltage ramp.

Figure 8:
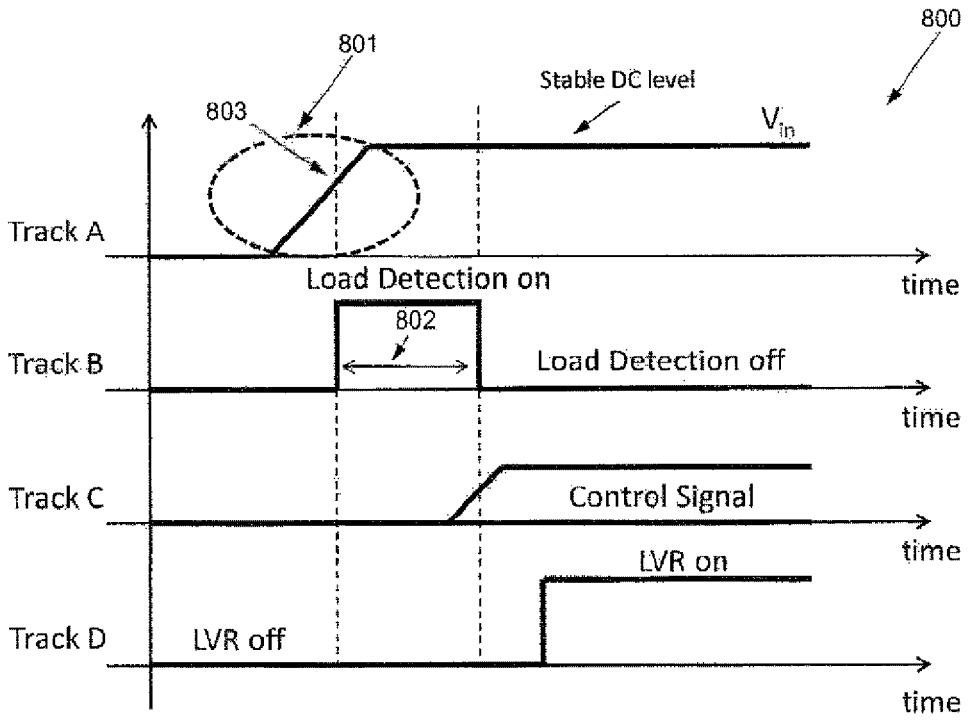
FIG. 8 shows the timing diagram to power on a capacitor-less LDO/load switch linear voltage regulator in accordance with embodiments of the invention.

FIG. 8 shows an example timing diagram (800) to illustrate the operation of the chip controller block (514), the load detection block (513), and the variable zero block (512) during the power-on phase of the capacitor-less LDO linear voltage regulator (500) shown in FIG. 5. As shown in FIG. 8, the timing diagram (800) includes track A through track D corresponding to the supply voltage input, the load detection on/off signal (514*b*), the control signal (513*a*), and the LVR on/off signal (514*a*), respectively, shown in FIG. 5.

Specifically, track A shows $V_{in}$ (i.e., supply voltage input to the capacitor-less LDO linear voltage regulator (500)) ramping from zero volt to a stable DC level during the ramp-up time (801). Track B shows the load detection on/off signal (514*b*) generated by the chip control block (514) to define a load_detection_on window (802) starting from when $V_{in}$ reaches a reliable voltage level (803) at the input terminal "Supply" of the chip control block (514). During the load_detection_on window (802), the load detection on/off signal (514*b*) activates the load detection block (513) to perform load parameters estimation. Track C shows the control signal (513*a*) generated by the load detection block (513) as the load parameters estimation is completed. Specifically, the control signal (513*a*) controls the variable zero block (512) to adapt the aforementioned zero to the required frequency.

Track D shows an LVR on/off signal (514*a*) generated by the chip controller block (514) to keep the capacitor-less LDO linear voltage regulator (500) in an off state by turning off various active elements. As a result, the $M_{pass}$ (507) is turned off during the load_detection_on window (802) and leaving the output voltage $V_{out}$ to be controlled by the load detection block (513). Subsequent to the completion of the load parameters estimation, the load detection on/off signal (514*b*) turns off the load detection block (513), and the LVR on/off signal (514*a*) turns on the capacitor-less LDO/load switch linear voltage regulator (LVR). Although a specific timing sequence is shown in FIG. 8, different timing approaches may also be used and the invention is not limited to embodiments shown in FIG. 8.

Figure 9:
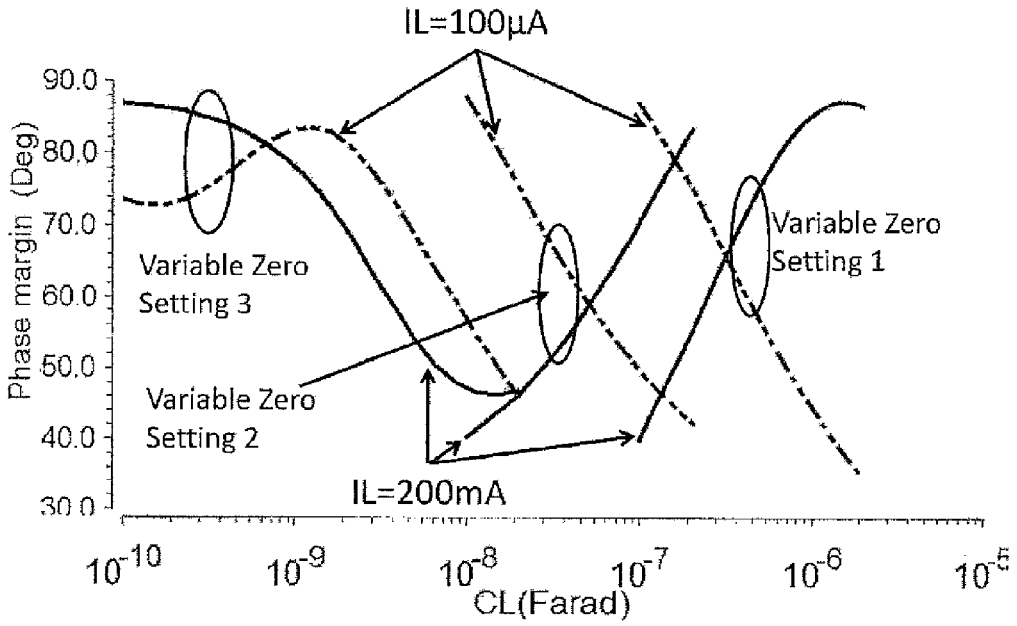
FIG. 9 shows example simulation results for phase margin under different load conditions of a LDO linear voltage regulator/load switch voltage regulator in accordance with embodiments of the invention.

FIG. 9 shows example simulation results for phase margin under different load conditions of the capacitor-less LDO linear voltage regulator (500) shown in FIG. 5. Specifically, FIG. 9 shows phase margin simulation results of two load conditions 100 μA (dotted curves in FIG. 9) and 200 mA (solid curves in FIG. 9) in combination with three variable zero settings. Variable zero setting 1, 2, and 3 are for load capacitances ranging from 0 nF to 20 nF, 10 nF to 200 nF and 100 nF to 2 μF, respectively. The variable zero setting 1 forces the zero of the variable zero block (512) to be placed at a lower frequency. As the load capacitance is decreased, the variable zero settings 2 and 3 increase the frequency of the zero generated by the variable zero block (512). Based on these simulation results, the optional load detection technique to adapt the internal zero in the improved capacitor-less LDO (500) achieves a phase margin better than 45 degree over a load capacitance range up to 10 μF. This enables the improved capacitor-less LDO (500) to supply load current up to a value higher than 500 mA.

Figure 10A:
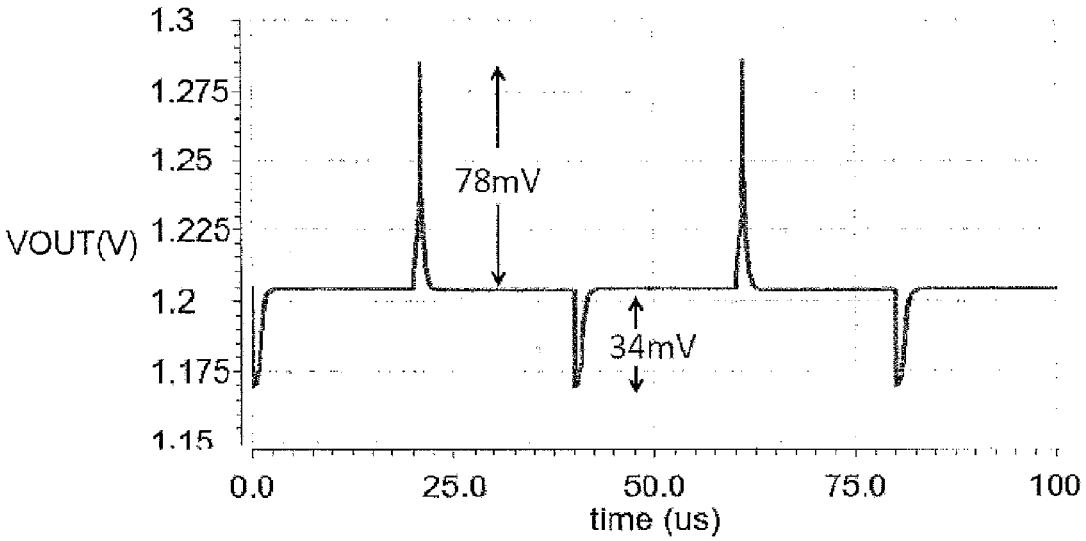
FIGS. 10A and 10B show example simulation results for load transient regulation of a LDO linear voltage regulator/load switch voltage regulator in accordance with embodiments of the invention.
Figure 10B:
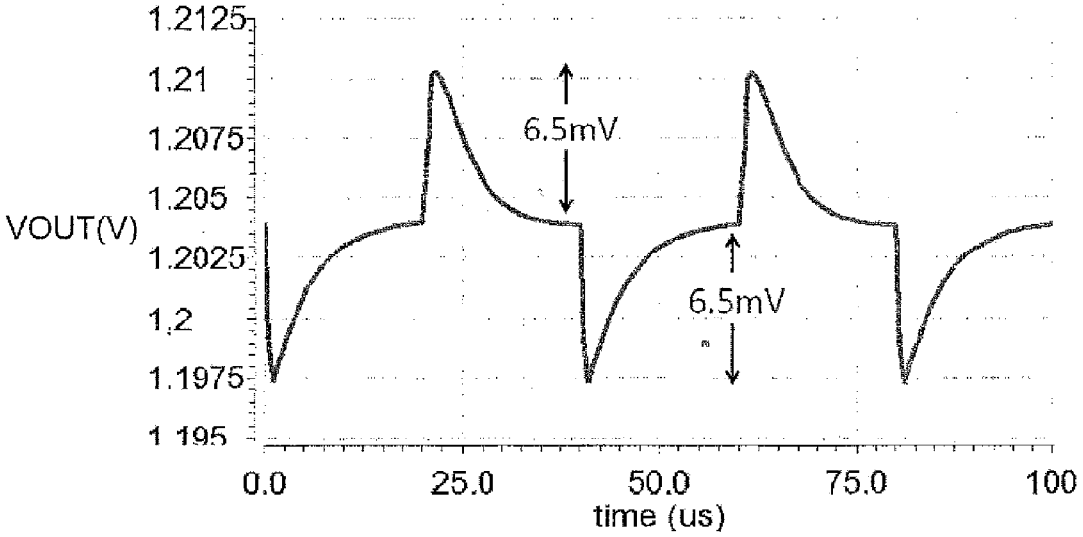

FIGS. 10A and 10B show example simulation results for load transient regulation of the capacitor-less LDO linear voltage regulator (500) shown in FIG. 5. Specifically, FIGS. 10A and 10B show example simulation results for load capacitances of 100 pF and 1 μF, respectively. These simulation results demonstrate that load transient regulation better than 80 mV is achieved, when the load current changes from 1 mA to 200 mA in 1 μsec. In all the simulated examples, load capacitances up to 10 μF are supported by the improved capacitor-less LDO (500). In contrast, prior art capacitor-less LDO architectures cannot support this wide range of load capacitances, and the reported load transient regulation is worse than 1V for the same test conditions used in the simulated example. On the other hand, LDOs that require an external capacitor achieve similar load transient regulation but cannot support load capacitances ranging from 0 to 10 μF.

In one or more embodiments, a supply rejection circuit (i.e., supply rejection blocks (303), (403), and (503) shown in FIGS. 3, 4, and 5, respectively, above) is used as an additional supply noise rejection circuit that injects a scaled version of the supply ripples at the gate of the pass transistor device (i.e., $M_{pass}$) in FIGS. 3, 4, and 5 to cancel out the effects of input ripples in $V_{in}$ on the output voltage $V_{out}$. Hence, a higher PSR is achieved at DC operation. The input ripples are any supply noise appearing at the input terminal ($V_{in}$) of an LDO, such as LDO (100) of FIG. 1, LDO (300) of FIG. 3 or LDO (500) of FIG. 5. Those skilled in the art, with the benefit of this disclosure, will appreciate that other circuit configurations may also be used to replicate supply noise for injecting to a particular circuit node in the LDO.

Figure 11:
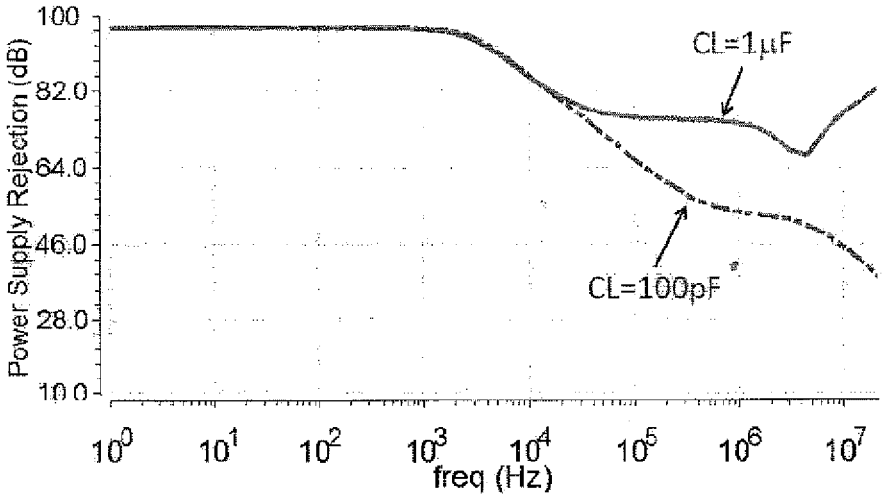
FIG. 11 shows example simulation results for power supply rejection of a LDO linear voltage regulator in accordance with embodiments of the invention.

Simulations have shown that the LDOs (300) and (500), depicted in FIGS. 3 and 5, respectively, above, may achieve PSR of 50 dB and 35 dB at 1 MHz and 10 MHz, respectively, without a supply rejection block. The PSR is enhanced by at least 15 dB across a wide frequency range when the supply rejection block is introduced. FIG. 11 shows the simulation results of the PSR at DC, 1 MHz and 10 MHz for the LDOs (300) and (500). As shown, a PSR better than 70 dB is achieved up to a frequency of 1 MHz, and better than 45 dB is achieved up to 10 MHz for a wide range of load conditions. This simulation is done for a load capacitance of 100 pF and load currents up to 200 mA. The simulation circuit parameters include an open loop gain higher than 70 dB, an amplifier offset better than 5 mV, and the value of $C_m$ is 200 pF. In contrast, simulations show that prior art capacitor-less LDOs (e.g., LDO shown in FIG. 2) typically achieve only 40 dB and 0 dB of PSR at 1 MHz and 10 MHz, respectively.

While the invention has been described for a low drop-out linear voltage regulator, the same technique and circuit configuration are equally applicable for a load switch. Therefore, such a circuit may be referred to generally as a "load switch linear voltage regulator (LVR) circuit" or "LVR circuit." That is, the term "LVR circuit" is intended to refer to such a circuit used for either of these two purposes. A load switch can be seen as a device having two main terminals: one terminal is for the input supply and the other terminal is for the output voltage (note: the device may include other terminals such as a ground and enable terminal). The output DC voltage changes proportionally with the input DC voltage proportionally. This load switch filters the high frequency supply noise without propagating it to the output. Similar to the capacitor-less LDO, there is also a capacitor-less load switch.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A low drop-out (LDO) load switch linear voltage regulator (LVR) circuit having an open loop transfer function, comprising:

a feedback network comprising: a first input coupled to an output of the LVR circuit; a second input coupled to a reference voltage; and an output; and a pass transistor comprising: a gate terminal driven by the output of the feedback network; a first terminal coupled to an input of the LVR circuit; and a second terminal coupled to the output of the LVR circuit, wherein the feedback network further comprises an output scaling network, an error amplifier, a first buffer, a second buffer, a capacitor, and a zero generation circuit that is connected to the first buffer and the second buffer, and is configured to generate a zero, wherein the first buffer comprises:

an input coupled to an output of the error amplifier and an input of the second buffer; and an output coupled to a first terminal of the capacitor, wherein the error amplifier comprises:

a first input for receiving the reference voltage; and a second input coupled to an output of the output scaling network, wherein the capacitor comprises:

the first terminal connected to the output of the first buffer; and a second terminal connected to the output of the LVR, wherein the second buffer comprises an output driving the gate terminal of the pass transistor, and wherein the output scaling network comprises:

an input connected to the output of the LVR; and the output connected to the second input of the error amplifier, wherein the output scaling network is configured to scale down an output voltage level of the LVR, using a resistive divider, and wherein the input of the first buffer is coupled to the output of the error amplifier and the input of the second buffer via the zero generation circuit.

2. The LVR circuit according to claim 1, wherein the feedback network is configured to regulate an output voltage level of the output of the LVR circuit based on a reference voltage, and wherein the pass transistor comprises at least one selected from a group consisting of an n-type field effect transistor, a p-type field effect transistor, and a bipolar junction transistor.

3. The LVR circuit according to claim 1, wherein the LVR circuit remains stable over a plurality of capacitive load conditions ranging from no capacitive load to a 10 .mu.F load.

4. The LVR circuit according to claim 1, wherein a dominant pole of the open loop transfer function of the LVR circuit is at the output of the LVR circuit over a predetermined frequency range and a plurality of pre-determined load conditions.

5. The LVR circuit according to claim 1, wherein a dominant pole of the open loop transfer function of the LVR circuit is at the output of the LVR circuit.

6. The LVR circuit according to claim 1, wherein the first buffer is configured to:

isolate the output of the error amplifier from being affected by load current variations of the LVR circuit; and add a zero to the open loop transfer function of the feedback network to reduce an effect of a non-dominant pole of the open loop transfer function.

7. The LVR circuit according to claim 1, wherein the second buffer is configured to increase a gain of the feedback network and for driving the pass transistor.

8. The LVR circuit according to claim 1, wherein the zero generation circuit comprises an adaptive RC network forming a low pass filter, and wherein a time constant of the adaptive RC network is controlled by a load detection circuit based on an estimated value of a load parameter.

9. The LVR circuit according to claim 8, wherein the adaptive RC network comprises at least one selected from a group consisting of a variable capacitor and a variable resistor controlled by the load detection circuit based on the estimated value of the load parameters that represent at least one selected from a group consisting of: a load time constant of an output voltage and a load resistor.

10. The LVR circuit according to claim 1, further comprising:

a supply rejection circuit configured to inject input ripples into the LVR circuit to reduce an effect of the input ripples.

11. The LVR circuit according to claim 1, wherein the pass transistor is configured to generate a V.sub.out output from a V.sub.in input; and the feedback network is coupled to the pass transistor and configured to adjust a gate control signal supplied to the pass transistor for regulating a voltage level of the V.sub.out output, wherein the gate control signal is adjusted based on a difference between a reference voltage signal and a sample of the voltage level of the V.sub.out output;

wherein the feedback network is configured to place a dominant pole at the V.sub.out output without using an external capacitor.

12. The low drop-out (LDO) load switch linear voltage regulator (LVR) circuit according to claim 11, further comprising:

a load detection circuit configured to estimate output load parameters that represent at least one selected from a group consisting of: a load time constant and a load resistor at the V.sub.out output, wherein the feedback network is adjusted based on the estimated output load parameters.

13. A low drop-out (LDO) load switch linear voltage regulator (LVR) circuit having an open loop transfer function, comprising:

a feedback network comprising: a first input coupled to an output of the LVR circuit; a second input coupled to a reference voltage; and an output; and a pass transistor comprising: a gate terminal driven by the output of the feedback network; a first terminal coupled to an input of the LVR circuit; and a second terminal coupled to the output of the LVR circuit, wherein the feedback network further comprises an output scaling network, an error amplifier, a first buffer, a second buffer, a capacitor, and a zero generation circuit that is connected to the first buffer and the second buffer, and is configured to generate a zero, wherein the LVR circuit further comprises a load detection circuit comprising:

an input coupled to the output of the LVR circuit; and an output coupled to the feedback network, and wherein the load detection circuit comprises:

a current source comprising:

a first terminal coupled to the output of the LVR circuit; and a second terminal coupled to a fixed potential node;

an amplifier comprising:

a first input coupled to the output of the LVR circuit; and a second input coupled to a constant voltage; and a decision circuit configured to generate a count proportional to a time period for the current source to charge the load parameter for the output of the LVR circuit to reach the constant voltage.

14. A low drop-out (LDO) load switch linear voltage regulator (LVR) circuit having an open loop transfer function, comprising:

a feedback network comprising: a first input coupled to an output of the LVR circuit; a second input coupled to a reference voltage; and an output; and a pass transistor comprising: a gate terminal driven by the output of the feedback network; a first terminal coupled to an input of the LVR circuit; and a second terminal coupled to the output of the LVR circuit, wherein the feedback network further comprises an output scaling network, an error amplifier, a first buffer, a second buffer, a capacitor, and a zero generation circuit that is connected to the first buffer and the second buffer, and is configured to generate a zero, and wherein the LVR circuit further comprises a load detection circuit comprising:

an input coupled to the output of the LVR circuit; and an output coupled to the feedback network, and wherein the LVR circuit further comprises a chip controller configured to:

activate the load detection circuit block during a power up phase of the LVR circuit; and de-activate the load detection circuit block subsequent to the power up phase of the LVR circuit.

15. The LVR circuit according to claim 14, wherein the load detection circuit is configured to:

estimate a load parameter that represents at least one selected from the group consisting of: a load time constant and a load resistor at the output of the LVR circuit; and generate a control signal to adjust at least one circuit parameter of the feedback network to prevent any oscillation at the output of the LVR circuit over a plurality of pre-determined load conditions.

16. A low drop-out (LDO) load switch linear voltage regulator (LVR) circuit having an open loop transfer function, comprising:

a feedback network comprising: a first input coupled to an output of the LVR circuit; a second input coupled to a reference voltage; and an output; and a pass transistor comprising: a gate terminal driven by the output of the feedback network; a first terminal coupled to an input of the LVR circuit; and a second terminal coupled to the output of the LVR circuit, wherein the feedback network further comprises an output scaling network, an error amplifier, a first buffer, a second buffer, a capacitor, and a zero generation circuit that is connected to the first buffer and the second buffer, and is configured to generate a zero, and wherein the LVR circuit further comprises a load detection circuit comprising:

an input coupled to the output of the LVR circuit; and an output coupled to the feedback network, and wherein the load detection circuit is configured to output a count representing an estimated load parameter that indicates if there is a short circuit at the output node of the LVR.

17. A method for adjusting stability of a low drop-out (LDO)/load switch linear voltage regulator (LVR) having an open loop transfer function, comprising:

determining, during a power-up phase and by a load detection circuit, an estimated output load parameter that represents at least one selected from a group consisting of: a load time constant and a load resistor value at an output node of the LDO/load switch LVR; and adjusting, based on the estimated output load parameter, an adaptive RC network in the LDO/load switch LVR, wherein the adaptive RC network produces an adaptive zero in a feedback network transfer function of the LDO/load switch LVR, and wherein the adaptive zero reduces an effect of a non-dominant pole in the open loop transfer function of the LDO/load switch LVR wherein the method further comprises:

estimating the output load parameter that represents at least one selected from a group consisting of: the load time constant and the load resistor value while the LDO/load switch LVR is in an off-state or while the LDO/load switch LVR is in a power-up state, wherein the LDO/load switch LVR remains stable over a plurality of capacitive load conditions ranging from no capacitive load to a 10 .mu.f load, wherein the method further comprises:

adjusting the adaptive RC network while estimating the output load parameters; and wherein the adjusting the adaptive RC network involves selecting a frequency of the adaptive zero to reduce phase margin degradation due to the non-dominant pole of the open loop transfer function of the LDO/load switch LVR.

18. A load detection circuit for a low drop-out (LDO) load switch linear voltage regulator (LVR) with a start-up behavior, comprising:

a measurement circuit for generating a value representing at least one selected from a group consisting of: a time constant of an output voltage, a load resistor, and a load capacitor connected to an output of the LDO load switch LVR before start-up; and a control circuit that optimizes, based on the value, the start-up behavior by controlling an output current of the voltage regulator, wherein the control circuit includes an adaptive RC network that produces an adaptive zero in a feedback network transfer function of the LDO/load switch LVR, and wherein the load detection circuit further comprises:

a charging circuit coupled to an output node of the LDO load switch LVR and configured to charge the output node;

a variable gain amplifier (VGA) coupled to the output node and configured to detect an output voltage level, and a decision circuit coupled to an output of the variable gain amplifier (VGA) and configured to generate outputs that are proportional to load parameters.

19. The load detection circuit according to claim 18, wherein a VGA gain value is proportional to the output voltage level and thus to the load resistor, wherein the decision circuit generates an output signal related to a charge time and to the time constant.

* * * * *